United States Patent [19]

Sundberg

[11] Patent Number: 4,461,338

[45] Date of Patent: Jul. 24, 1984

[54] HORIZONTAL CONTINUOUS CASTING OF METALS

[75] Inventor: Yngve Sundberg, Västerås, Sweden

[73] Assignee: ASEA AB, Västerås, Sweden

[21] Appl. No.: 321,544

[22] Filed: Nov. 16, 1981

[30] Foreign Application Priority Data

Dec. 22, 1980 [SE] Sweden ..... 8009058

[51] Int. Cl.[3] ..... B22D 27/02

[52] U.S. Cl. ..... 164/466; 164/502

[58] Field of Search ..... 164/466, 467, 498, 504, 164/440, 490, 502

[56] References Cited

U.S. PATENT DOCUMENTS 3,976,117 8/1976 Olsson ..... 164/48

4,020,890 5/1977 Olsson ..... 164/466

4,033,397 7/1977 Laithwaite ..... 164/467

FOREIGN PATENT DOCUMENTS 2048140 12/1980 United Kingdom ..... 164/466

550227 3/1977 U.S.S.R. ..... 164/466

*Primary Examiner*—Nicholas P. Godici

*Assistant Examiner*—Jerold L. Johnson

*Attorney, Agent, or Firm*—Kenyon & Kenyon

[57] ABSTRACT

A melt is continuously horizontally cast by causing the melt to flow forwardly while spreading laterally to form a flat product. A magnetic field is directed perpendicularly through the flow where it is thicker so as to form the product with a uniform thickness throughout its width.

5 Claims, 3 Drawing Figures

HORIZONTAL CONTINUOUS CASTING OF METALS

The horizontal continuous casting of metals is done by pouring a continuous stream of molten metal on a substantially horizontal support means so as to cause the metal to flow forwardly while gravitational spreading laterally to form a forwardly traveling flat product or strip. Aluminum and its alloys can be cast in this manner and possibly also copper and iron and their alloys.

The support means can comprise a declining supporting plate to the high end of which the stream of molten metal is fed so that the metal gravitationally flows down the plate while spreading laterally. A horizontal metal belt span can run continuously forwardly at the low end of this plate to receive the spread metal and carry it away as a solidifying strip. In another form the metal stream can be fed directly to a horizontal forwardly moving belt span so that the metal flowing with the span gravitationally spreads laterally.

The essential thing is the provision on some means which supports the metal while causing the metal to flow or move forwardly while gravitationally spreading laterally. The means must be capable of resisting the heat of the molten metal but this is not difficult to do because it is usually aluminum and its alloys that are cast as described.

Because gravity alone is used to spread the metal from its stream form, precisely uniform spreading to the desired flat product from having a uniform thickness throughout its width, does not usually result. Because of the casting conditions the cast product normally has a thick center.

The object of the present invention is to provide an improvement which substantially reduces or eliminates such uneven gravitational spreading of the forwardly flowing molten metal, so that the product cast has a substantially uniform thickness throughout its width.

Basically, to achieve the above object, a magnetic field is directed substantially perpendicularly through the spreading molten metal at any location where the flow has a greater thickness than elsewhere. In this way, an electrodynamic braking force is exerted on the thicker portion or portions so as to effect their more rapid spreading than is effected by the gravitational spreading alone. A smoothing-out action is obtained which appears to have its best effect when the magnetic field is at a location where the molten metal has already gravitationally spread substantially and is close to the location of ultimate spreading.

For maximum effect the magnetic field in each instance is formed by positioning DC electromagnets above and below the spreading metal or melt and having pole pieces vertically aligned and facing each other and of mutually opposite polarity. The polarity should be non-reversing. The support means over which the melt is spreading is necessarily within the path of this field and should therefore be made of non-magnetic but adequately refractory material such as stainless steel in the case of aluminum and its alloys. For high melting temperature metals and alloys, a ceramic supporting and spreading surface can be used.

The principles of electrodynamic braking are given below:

The relationship $$\bar{E}=\bar{v}\times\bar{B}$$

where $E$ is the field strength in $V/m$, $v$ is the speed of the melt in $m/s$ and $B$ is the flux density in Tesla and the relationship $$\bar{s}=\rho\times\bar{E}$$

where $s$ is the current density in $A/m^2$ and $\rho$ is the resistivity in the molten material in ohm$\times m$, will result in the relationship $$\bar{f}=\bar{s}\times\bar{B}$$

where $\bar{f}$ is the volume force in Newton/$m^3$. The current density $\bar{s}$ is directed horizontally across the longitudinal direction of the strip, and the force $\bar{f}$ is directed opposite to the flow when $\bar{B}$ is directed perpendicularly to the surface of the strip. The oppositely directed force $\bar{f}$ slows down the material in the melt and distributes it outwards towards the edges.

BRIEF DESCRIPTION OF THE DRAWINGS

An example of a practical application of the above principles is schematically illustrated by the accompanying drawings in which.

DETAILED DESCRIPTION OF THE INVENTION

In these drawings the desired flat product or strip is shown at 1 supported on a forwardly traveling belt span moving in the direction B and beneath the product 1 which hides the belt. At the location A the melt stream is poured on the declining plate P and the forwardly flowing melt starts thick as compared to its width because the gravitational force has not yet had much influence. Moving along to the right in FIG. 1 it can be seen that as the melt flow continues this force begins its effect, gradually causing the flow to spread laterally until it ultimately reaches the desired width of the strip 1. However, the lateral flow is not normally uniform laterally, some of its original thickness starting at A being retained.

Figure 2:
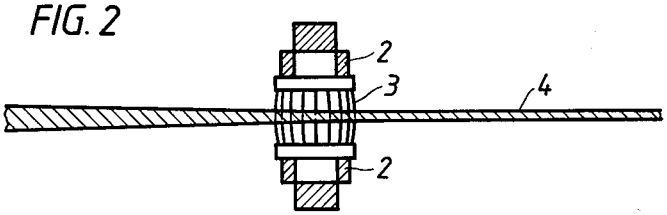
FIG. 2 is a longitudinal section and FIG. 3 is an end view.
Figure 3:
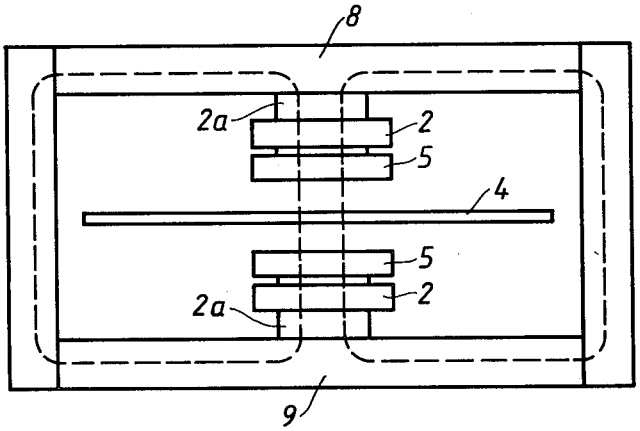

For correction electromagnets having the coils 2 are positioned above and below the spreading melt so as to provide the uniform flat strip thickness indicated at 4 in FIG. 2. The thicker melt portion is slowed so it must flow laterally in opposite directions. Each coil 2 has pole pieces 5 which respectively face the spreading melt towards its top and bottom. The coils 2 should be wound and DC powered to provide the non-reversing magnetic field 3 which extends through the melt perpendicularly. For maximum field strength the pole pieces 5 are magnetically connected to cores 2a for the coils and the cores with a suitable yoke 8 which encircles the spreading metal with clearance and provides closed magnetic circuits except for the air gap through which the melt travels.

Figure 1:
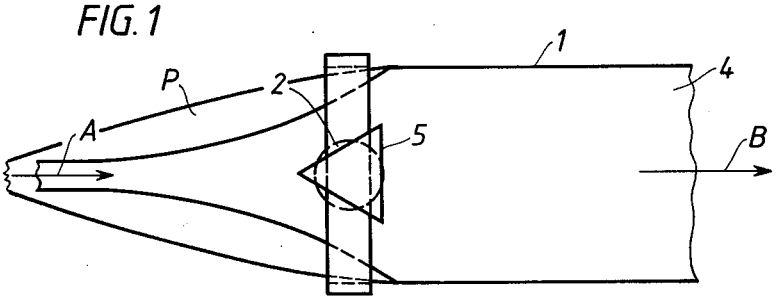
FIG. 1 is a plan view.

The pair of electromagnets should preferably be made adjustable so that the magnetic field 3 can be placed where the melt flow is thicker than elsewhere. As illustrated by FIG. 1 the pole pieces 5 can be made triangular or wedge-shaped and pointed in a direction opposite to the direction of the melt flow, with the field 3 then acting to split and spread the thicker melt flow portion. The apparatus used should be designed so that the field 3 can be placed where it is needed and if necessary more than one pair of electromagnets can be used. The pole pieces can be made replaceable by others of different shapes as may be required by the melt flow conditions.

What is claimed is:

1. A horizontal continuous metal casting method comprising pouring a continuous stream of molten metal on a substantially horizontal, non-magnetic, flat support on which the stream flows substantially horizontally forwardly while gravitationally spreading unevenly laterally in a horizontal direction so as to form into a forwardly traveling gradually forming flat flow having at least one forwardly flowing portion that is thicker than the balance of the flow laterally on the sides of that portion; and directing a non-reversing DC magnetic field substantially perpendicularly through said portion and the non-magnetic support so as to cause an electrodynamic braking force to be exerted on said portion and cause it to spread laterally in the horizontal direction more rapidly than by said gravitational spreading alone and provide a smoothing-out effect on the flow so that the flow is made substantially flat and of uniform thickness.

2. The method of claim 1 in which said field is formed with a triangular cross section having an apex pointing backwardly with respect to the forward flow of molten metal.

3. The method of claim 1 in which said flow reaches a forward location where it ultimately stops gravitationally spreading laterally in a horizontal direction, and said field is positioned closely in front of said location.

4. A horizontal continuous casting apparatus comprising a substantially horizontal, non-magnetic, elongated, flat support adapted to receive a stream of molten metal at a first portion and cause it to flow forwardly while gravitationally spreading laterally on the support in a horizontal direction so as to form a substantially flat flow, the support having a second portion spaced forwardly from said first portion adapted to support an ultimate spreading of the flow and between said first and second portions having magnetic means for directing a non-reversing DC magnetic field through only a predetermined central portion of said flow.

5. The apparatus of claim 4 in which said magnetic means comprises at least one DC electromagnet having a triangular or wedge-shaped pole-piece positioned so as to direct said field through said portion of said flow and pointing towards said first portion of said support.

* * * * *